US010385846B2

(12) United States Patent
Kreye

(10) Patent No.: US 10,385,846 B2
(45) Date of Patent: Aug. 20, 2019

(54) PISTON PUMP HAVING PUSH ROD ASSEMBLY AND STOPPING ASSEMBLY

(71) Applicant: Caterpillar Motoren GmbH & Co. KG, Kiel (DE)

(72) Inventor: Jan M. Kreye, Graasten (DK)

(73) Assignee: Caterpillar Motoren GmbH & Co. KG, Kiel (DE)

( * ) Notice: Subject to any disclaimer, the term of this patent is extended or adjusted under 35 U.S.C. 154(b) by 133 days.

(21) Appl. No.: 15/726,879

(22) Filed: Oct. 6, 2017

(65) Prior Publication Data

US 2018/0100501 A1 Apr. 12, 2018

(30) Foreign Application Priority Data

Oct. 7, 2016 (GB) ..... 1617038.3

(51) Int. Cl.

| | |
|---|---|
| ***F04B 53/14*** | (2006.01) |
| *F02M 59/02* | (2006.01) |
| *F04B 53/16* | (2006.01) |

(52) U.S. Cl.

CPC ..... *F04B 53/144* (2013.01); *F02M 59/02* (2013.01); *F04B 53/16* (2013.01)

(58) Field of Classification Search

CPC ..... F02M 59/02; F02M 59/025; F04B 53/144

See application file for complete search history.

(56) References Cited

U.S. PATENT DOCUMENTS

| | | | | |
|---|---|---|---|---|
| 4,714,066 | A * | 12/1987 | Jordan | F02D 1/10 123/25 A |
| 4,842,497 | A * | 6/1989 | Hafele | F02M 59/24 123/495 |
| 2010/0303656 | A1 | 12/2010 | Lin et al. | |
| 2013/0195692 | A1 | 8/2013 | Sakoh et al. | |

FOREIGN PATENT DOCUMENTS

| | | | | |
|---|---|---|---|---|
| DE | 4409555 | A1 * | 9/1995 | F02M 59/442 |
| EP | 0237112 | | 9/1987 | |
| EP | 2865103 | | 4/2015 | |
| EP | 3418551 | A2 * | 12/2018 | F02M 59/00 |
| FR | 2954417 | | 6/2011 | |

* cited by examiner

*Primary Examiner* — Thomas E Lazo

(57) ABSTRACT

A stopping assembly of a piston pump is disclosed. The stopping assembly includes a base portion having an inner surface for movably receiving a push rod assembly of the piston pump and an outer surface opposite to the inner surface engaged with a housing of the piston pump. The stopping assembly also includes a plurality of protruded structures adjacently disposed on the base portion forming a plurality of grooves extending from the inner surface towards the outer surface to allow fluid to flow towards the outer surface.

17 Claims, 9 Drawing Sheets

PISTON PUMP HAVING PUSH ROD ASSEMBLY AND STOPPING ASSEMBLY

TECHNICAL FIELD

The present disclosure relates to piston pumps, and more particularly relates to a push rod assembly, a stopping assembly, and a piston pump having the push rod assembly and the stopping assembly.

BACKGROUND

Internal combustion engines are often equipped with a piston pump in a fuel supply system. The piston pump may feed fuel from a reservoir to a fuel injection valve. The piston pump usually includes a push rod adapted to make a reciprocating movement within a chamber, a stopper for concentrically receiving the push rod, and a sealing ring disposed between the push rod and the stopper. The stopper is also utilized for limiting a downward movement of the push rod. In particular, the stopper may be disposed at a bottom of a housing of the piston pump, and may limit the downward movement of the push rod, when a bottom surface of the push rod comes into contact with a top surface of the stopper.

Further, the fuel is usually accumulated in the chamber, and is moved by the reciprocating movement of the push rod. For example, when the push rod is moving towards the top surface of the stopper, the fuel available in the chamber gets pressurized between the push rod and the stopper. As a result, pressure surges are created in the fuel flowing towards the sealing ring hampering the operation of the sealing ring. Generally, sealing rings are not manufactured to withstand such pressure surges of the fuel. As a result, the sealing rings fail and have to be frequently replaced. This would lead to inconvenience and expenses with regard to replacement and maintenance of the sealing ring. Moreover, after flowing past the sealing ring, the fuel may get mixed with lubrication oil resulting into a dilution of the lubrication oil. The lubrication oil may also have to be replaced once the dilution makes the lubrication oil unusable, for example, due to decrease in viscosity. The maintenance of the sealing ring and the lubrication oil may lead to a significant machine downtime and affect an overall performance of an engine.

SUMMARY OF THE DISCLOSURE

In one aspect of the present disclosure, a stopping assembly of a piston pump is provided. The stopping assembly includes a base portion having an inner surface for movably receiving a push rod assembly of the piston pump and an outer surface opposite to the inner surface engaged with a housing of the piston pump. The stopping assembly also includes a plurality of protruded structures adjacently disposed on the base portion forming a plurality of grooves. The plurality of grooves extends from the inner surface towards the outer surface to allow fluid to flow towards the outer surface.

In another aspect of the present disclosure, a push rod assembly of a piston pump is provided. The push rod assembly includes a rod coupled to a piston of the piston pump. The rod is adapted to perform a reciprocating movement within a housing of the piston pump. The push rod assembly includes a stopper portion having an inner surface fixedly engaged with the rod and an outer surface opposite to the inner surface. The push rod assembly further includes a plurality of protruded structures adjacently disposed on a first surface of the stopper portion forming a plurality of grooves extending from the inner surface towards the outer surface to allow fluid to flow towards the outer surface.

In yet another aspect of the present disclosure, a piston pump is provided. The piston pump includes a housing, a piston movably disposed in the housing, and a push rod assembly coupled to the piston. The push rod assembly is adapted to perform a reciprocating movement within the housing along with the piston. The push rod assembly includes a rod portion and a stopper portion. The stopper portion has an inner surface fixedly engaged with the rod portion and an outer surface opposite to the inner surface. The piston pump includes a stopping assembly for limiting a movement of the push rod assembly within the piston pump. The stopping assembly includes a base portion having an inner surface for movably receiving the push rod assembly and an outer surface opposite to the inner surface engaged with the housing. The piston pump further includes a plurality of protruded structures adjacently disposed on at least one of a first surface of the stopper portion and a first surface of the base portion. The plurality of protruded structures forms a plurality of grooves extending outwardly from the inner surface of one of the stopper portion and the base portion.

Other features and aspects of this disclosure will be apparent from the following description and the accompanying drawings.

DETAILED DESCRIPTION

Figure 1:
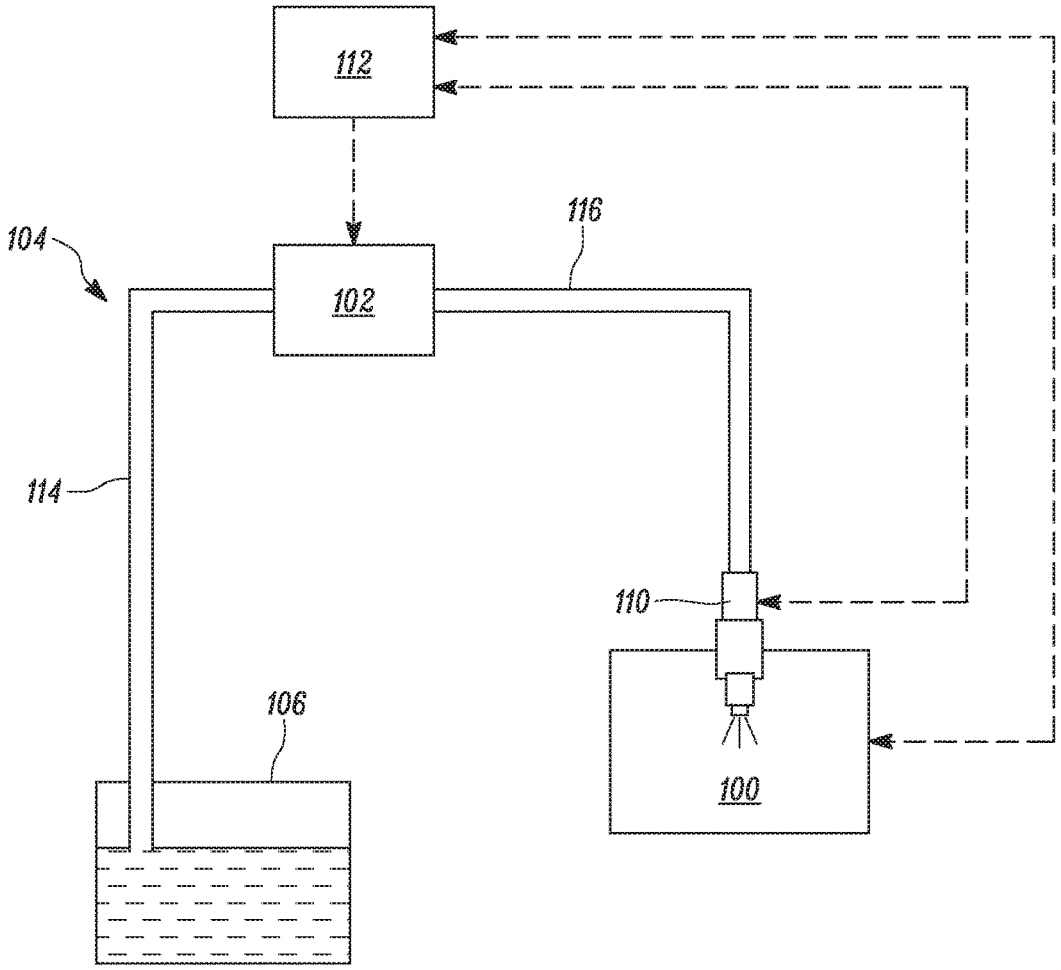
FIG. 1 is a block diagram of an internal combustion engine with a piston pump, according to one embodiment of the present disclosure.

Wherever possible, the same reference numbers will be used throughout the drawings to refer to the same or the like parts. FIG. 1 is a block diagram of an internal combustion engine 100 with a piston pump 102, according to one embodiment of the present disclosure. In the present embodiment, the piston pump 102 may be employed as a high-pressure fuel pump in a machine (not shown) having the internal combustion engine 100. In other embodiments, the piston pump 102 may be employed in other systems of the machine, such as in a braking system (not shown), without departing from the scope of the present disclosure. In the present disclosure, the internal combustion engine 100 is interchangeably referred to as engine 100.

In one embodiment, the machine may include a fuel supply system 104 for supplying fuel to the engine 100. In the present embodiment, the fuel supply system 104 may be a pump-line nozzle system. The fuel supply system 104 may include, but is not limited to, a fuel reservoir 106, the piston pump 102, a fuel injection nozzle 110, and an Electronic Control Unit (ECU) 112. The fuel supply system 104 may further include a first conduit 114 for connecting the fuel reservoir 106 with the piston pump 102, and a second conduit 116 for connecting the piston pump 102 with the fuel injection nozzle 110. Therefore, the fuel reservoir 106, the first conduit 114, the piston pump 102, the second conduit 116, and the fuel injection nozzle 110 are fluidly coupled with each other. Further, the ECU 112 may be in communication with the piston pump 102, the fuel injection nozzle 110, and the engine 100.

In one embodiment, the fuel to be delivered to the engine 100 may be stored in the fuel reservoir 106. The fuel may be delivered from the fuel reservoir 106 to the piston pump 102 through the first conduit 114. In one embodiment, the fuel supply system 104 may include a supply pump (not shown) for pumping the fluid from the fuel reservoir 106 towards the piston pump 102. The piston pump 102 may pressurize the fuel, and may then supply the pressurized fuel to the fuel injection nozzle 110 through the second conduit 116. The operational and constructional features of the piston pump 102 are explained in detail in the description of FIG. 2.

In one embodiment, the fuel injection nozzle 110 may be disposed in a cylinder head (not shown) of a cylinder (not shown) of the engine 100. The fuel injection nozzle 110 may be adapted to inject the fuel received from the piston pump 102 into the cylinder. In one embodiment, the fuel injection nozzle 110 may include a needle valve (not shown) for controlling a flow of the fuel towards the cylinder. In an open state, the needle valve of the fuel injection nozzle 110 may allow the fuel from the second conduit 116 to flow towards the cylinder of the engine 100. In a closed state, the needle valve of the fuel injection nozzle 110 may block the flow of the fuel from the second conduit 116 towards the cylinder. In one embodiment, the ECU 112 may control the opening and closing of the needle valve of the fuel injection nozzle 110 for selectively allowing the fuel to enter the cylinder of the engine 100 through the fuel injection nozzle 110.

In one embodiment, the engine 100 may include multiple cylinders. In such an embodiment, for each cylinder of the engine 100, the fuel supply system 104 may include one fuel injection nozzle 110. Further, the fuel supply system 104 may include one piston pump 102 for each fuel injection nozzle 110. Therefore, in one embodiment with multiple fuel injection nozzles 110, the fuel supply system 104 may include multiple piston pumps 102. Although the present disclosure is explained with regard to one piston pump 102 for one fuel injection nozzle 110, the present disclosure is equally applicable for the multiple piston pumps 102 supplying the fuel to the multiple fuel injection nozzles 110.

Figure 2:
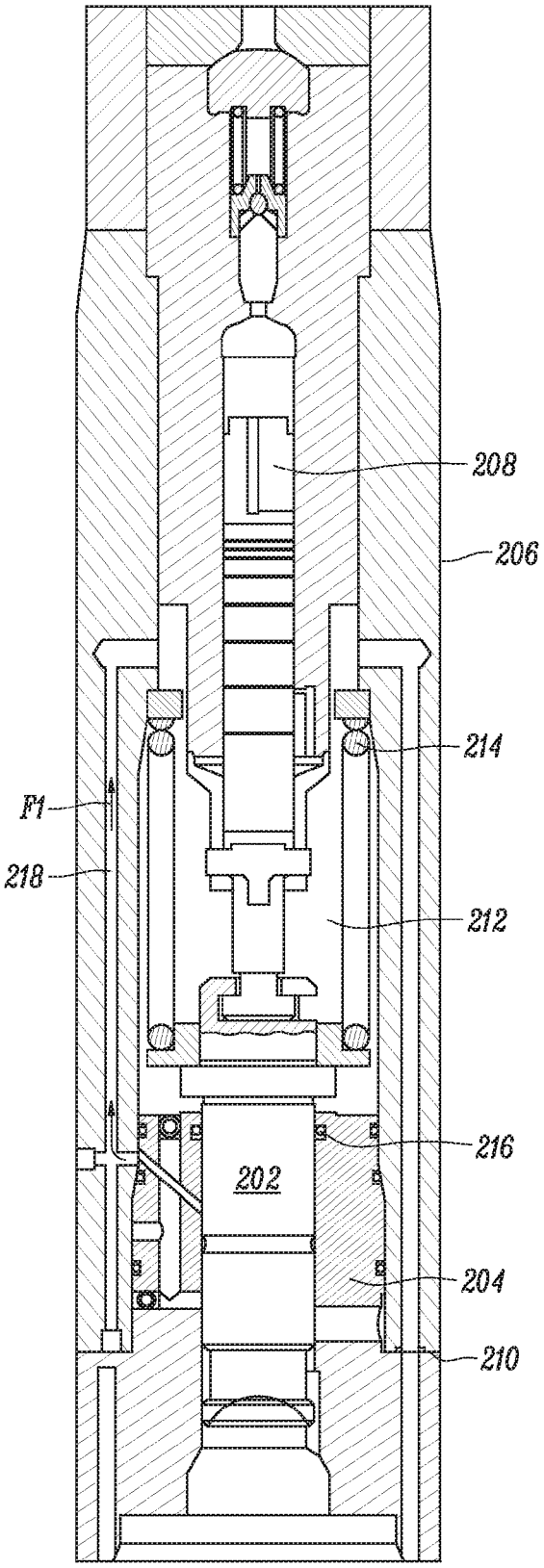
FIG. 2 is a cross-sectional view of the piston pump having a push rod assembly and a stopping assembly, according to one embodiment of the present disclosure.

FIG. 2 illustrates a cross-sectional view of the piston pump 102 having a push rod assembly 202 and a stopping assembly 204, according to one embodiment of the present disclosure. The piston pump 102 may include a housing 206, a piston 208 movably disposed within the housing 206, the push rod assembly 202 coupled to the piston 208, and the stopping assembly 204 disposed at or near a bottom 210 of the housing 206. The fuel from the second conduit 116 may enter the housing 206 through the fuel injection nozzle 110, and may lubricate the piston 208.

The piston 208 may be coupled to the push rod assembly 202 which may in turn be coupled to an external push rod assembly (not shown). The external push rod assembly may enable the push rod assembly 202 to perform a reciprocating movement within the housing 206. Further, since the piston 208 is coupled to the push rod assembly 202, the piston 208 may also perform a reciprocating movement within the housing 206. Therefore, the push rod assembly 202 may be adapted to perform the reciprocating movement within the housing 206 along with the piston 208. A region of movement of the push rod assembly 202 within the housing 206 may be referred to as a chamber 212. The constructional and operational features of the push rod assembly 202 are explained in detail in the description of FIG. 3, FIG. 4, FIG. 7, FIG. 8, and FIG. 9.

In one embodiment, the piston pump 102 may also include one or more springs 214 disposed within the chamber 212. In such an embodiment, for the reciprocating movement, the external push rod assembly may push the push rod assembly 202 towards the piston 208 whereas the springs 214 may push the push rod assembly 202 back towards the bottom 210 of the housing 206.

In one embodiment, the movement of the push rod assembly 202 towards the bottom 210 of the housing 206 may be limited by the stopping assembly 204. In one embodiment, the stopping assembly 204 may be a flange-like structure, and may be mounted in the housing 206 by using fasteners, such as screws. During the reciprocating movement, the push rod assembly 202 may be moving through the stopping assembly 204. In one embodiment, the movement of the push rod assembly 202 may be restricted when the push rod assembly 202 comes in contact with a first surface (shown in FIG. 3) of the stopping assembly 204, for example, when the piston 208 is at a bottom dead center. The constructional and operational features of the stopping assembly 204 are explained in detail in the description of FIG. 3, FIG. 4, FIG. 5, and FIG. 6.

In one embodiment, the piston pump 102 may further include a sealing ring 216 disposed between the push rod assembly 202 and the stopping assembly 204. The sealing ring 216 may be disposed in order to ensure a smooth movement of the push rod assembly 202 through the stopping assembly 204. Further, the sealing ring 216 may provide sealing between the push rod assembly 202 and the stopping assembly 204. Therefore, the sealing ring 216 may restrict the fuel or any other fluid from flowing between the push rod assembly 202 and the stopping assembly 204.

In one embodiment, the reciprocating movement of the push rod assembly 202 may cause a lubrication oil to be drawn into the housing 206 from a fluid reservoir (not shown). In one embodiment, the lubrication oil may be accumulated in the chamber 212. On the other hand, due to the reciprocating movement of the piston 208, the fuel coming through the fuel injection nozzle 110 may naturally flow along sides of the piston 208, and may also get accumulated in the chamber 212. Therefore, in the chamber 212, the fuel may mix with the lubrication oil to form a mixed fluid, also referred to as fluid. In one embodiment, the fluid may include equal to or more than 90% as the fuel, by volume.

In one embodiment, at least one of the stopping assembly 204 and the push rod assembly 202 may include a plurality of protruded structures (shown in FIG. 3) in such a manner that when the fluid is pressurized during the reciprocating movement of the push rod assembly 202 and the piston 208, the fluid by-passes the sealing ring 216 by flowing radially towards the sides of the push rod assembly 202. In one embodiment, the plurality of protruded structures may be formed on at least one of the stopping assembly 204 and the push rod assembly 202 by a milling operation. In other embodiments, the plurality of protruded structures may be formed on at least one of the stopping assembly 204 and the push rod assembly 202 by other manufacturing techniques, without departing from the scope of the present disclosure.

In one embodiment, when being pressurized, the fluid may follow a flow path F1, where the fluid may flow upwards through a conduit 218 into the chamber 212. From the chamber 212, the fluid may flow out of the housing 206, when the fluid becomes unusable. The flow of the fluid along the flow path F1 may result in a controlled sleeve lubrication of the piston 208 and the push rod assembly 202.

Figure 3:
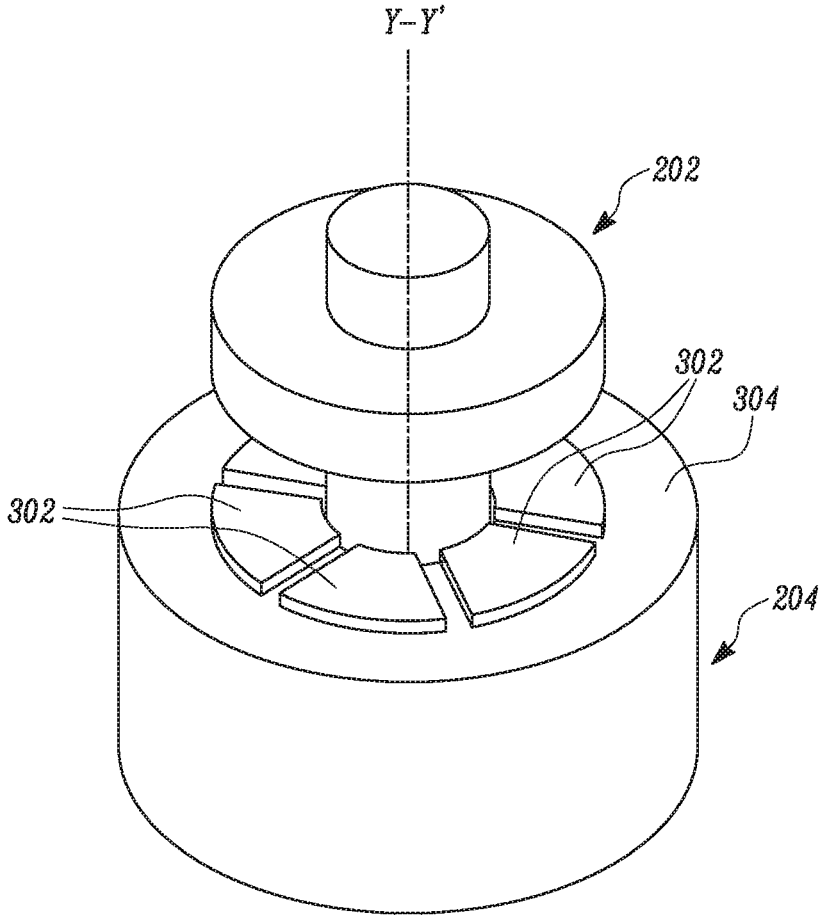
FIG. 3 is a perspective view of the push rod assembly and the stopping assembly, according to one embodiment of the present disclosure.
Figure 4:
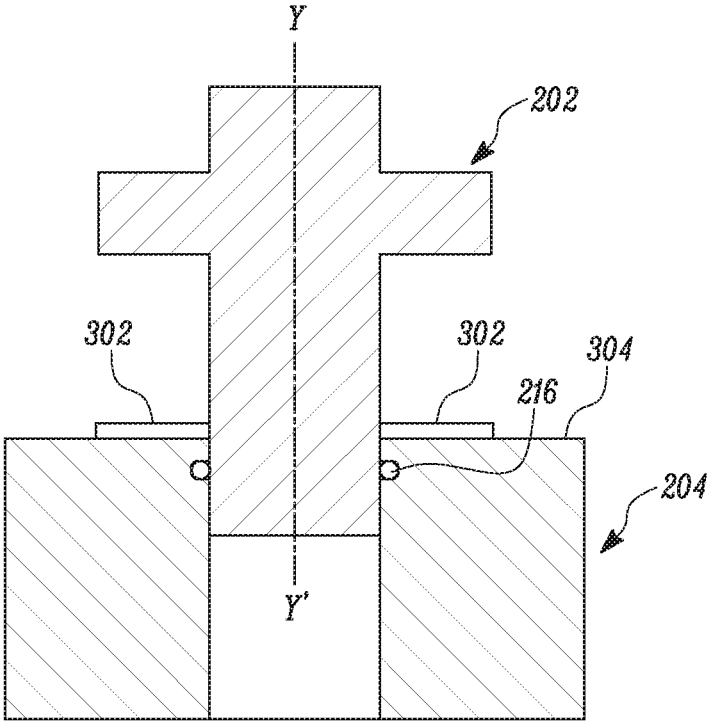
FIG. 4 is a cross-sectional view of the push rod assembly and the stopping assembly, according to one embodiment of the present disclosure.

FIG. 3 illustrates a perspective view of the push rod assembly 202 and the stopping assembly 204, according to one embodiment of the present disclosure. In the present embodiment, the stopping assembly 204 may include a plurality of protruded structures 302. As shown, the push rod assembly 202 may be adapted to move through the stopping assembly 204 for performing the reciprocating movement. The movement of the push rod assembly 202 towards the bottom 210 of the housing 206 may be restricted when the push rod assembly 202 comes in contact with the first surface 304 of the stopping assembly 204. FIG. 4 illustrates a cross-sectional view of the push rod assembly 202 and the stopping assembly 204, according to the embodiment of FIG. 3. As shown, the sealing ring 216 may be disposed between the push rod assembly 202 and the stopping assembly 204.

Figure 5:
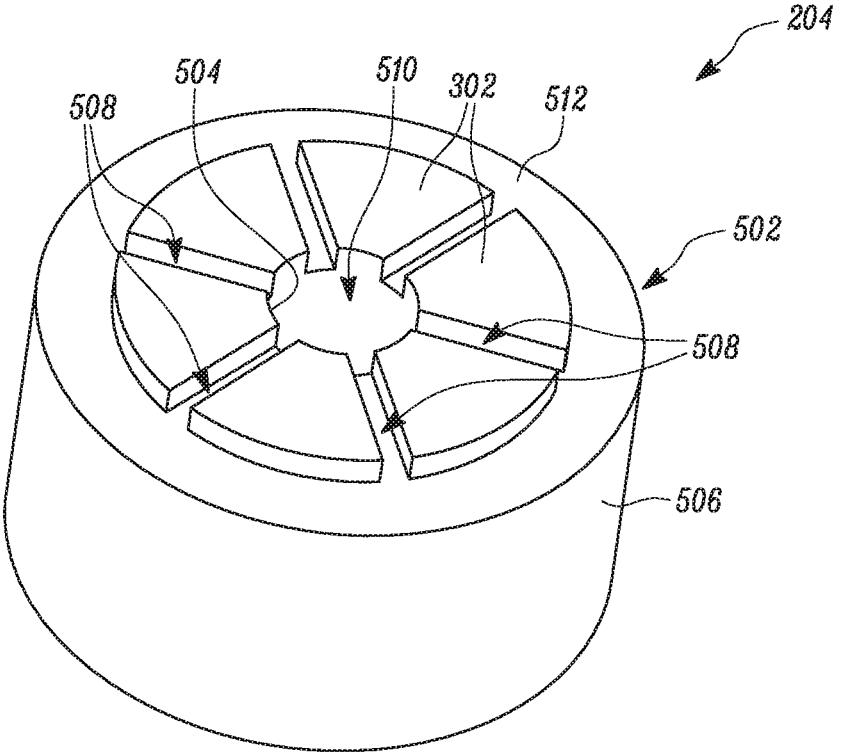
FIG. 5 is a perspective view of the stopping assembly having a plurality of protruded structures, according to one embodiment of the present disclosure.

FIG. 5 illustrates a perspective view of the stopping assembly 204 having the plurality of protruded structures 302, according to one embodiment of the present disclosure. The stopping assembly 204 may include a base portion 502 having an inner surface 504 and an outer surface 506 opposite to the inner surface 504. The inner surface 504 may define a bore 510 in the base portion 502 for movably receiving the push rod assembly 202. The inner surface 504 may be adapted to receive the push rod assembly 202 for accommodating the reciprocating movement of the push rod assembly 202. Further, the outer surface 506 may be adapted to engage with the housing 206 of the piston pump 102.

The plurality of protruded structures 302 may be adjacently disposed on the base portion 502. The plurality of protruded structures 302 may be formed on a first surface 512 of the base portion 502. The plurality of protruded structures 302 may be adjacently disposed forming a plurality of grooves 508 on the first surface 512 of the base portion 502. The plurality of grooves 508 may extend from the inner surface 504 of the stopping assembly 204 towards the outer surface 506 of the stopping assembly 204 for allowing the fluid to flow towards the outer surface 506. In one embodiment, when the fluid is pressurized between the push rod assembly 202 and the stopping assembly 204, the fluid may flow towards the outer surface 506 of the stopping assembly 204 through the plurality of grooves 508.

In one embodiment, the plurality of grooves 508 may extend radially from the inner surface 504 towards the outer surface 506. For example, with regard to a vertical axis YY' of the push rod assembly 202, the plurality of grooves 508 may be extending in a radially outward direction. In the embodiment shown in FIG. 5, the stopping assembly 204 includes six protruded structures 302 adjacently disposed on the base portion 502 forming six grooves 508 extending from the inner surface 504 towards the outer surface 506.

In one embodiment, at least one groove 508, from the plurality of grooves 508 may have a square cross-section, a rectangular cross-section, or a circular cross-section. In one embodiment, the at least one groove 508 may have a varying cross-section. In one embodiment, the varying cross-section of the at least one groove 508 may be increasing from the inner surface 504 towards the outer surface 506. In one embodiment, the cross-section of the at least one groove 508 may be varied by varying one of a width or a depth of the at least one groove 508. In one embodiment, the cross-section of the at least one groove 508 may be varied by varying the width and the depth of the at least one groove 508.

Figure 6:
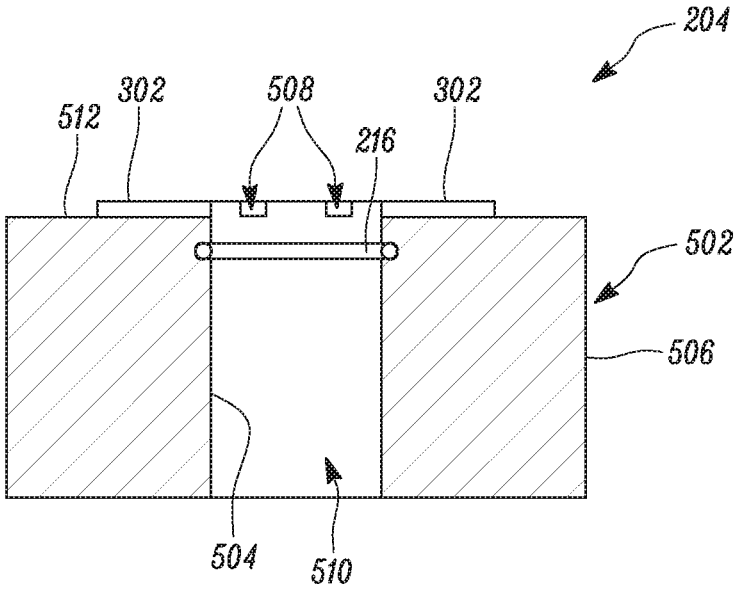
FIG. 6 is a cross-sectional view of the stopping assembly of FIG. 5, according to one embodiment of the present disclosure.

FIG. 6 is a cross-sectional view of the stopping assembly 204 of FIG. 5, according to one embodiment of the present disclosure. As shown, the sealing ring 216 may be disposed within the stopping assembly 204 in such a manner that the sealing ring 216 may contact the push rod assembly 202 during the reciprocating movement of the push rod assembly 202 through the bore 510 of the stopping assembly 204.

Figure 7:
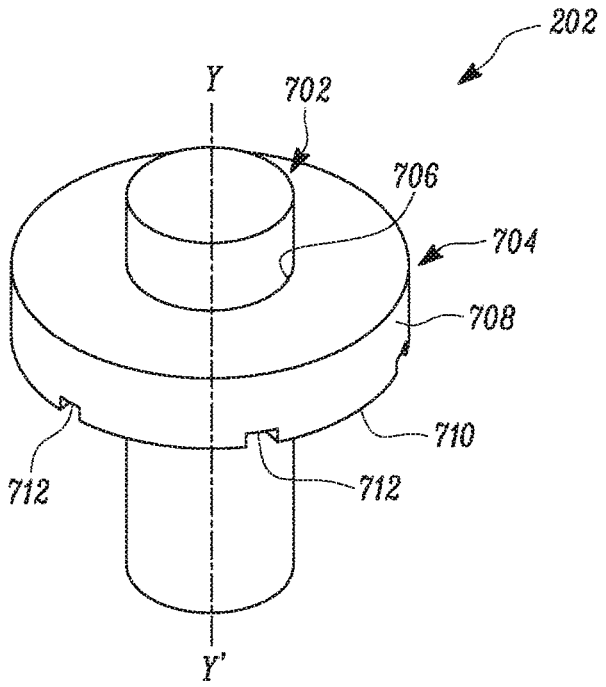
FIG. 7 is a perspective view of the push rod assembly having a plurality of protruded structures, according to one embodiment of the present disclosure.
Figure 9:
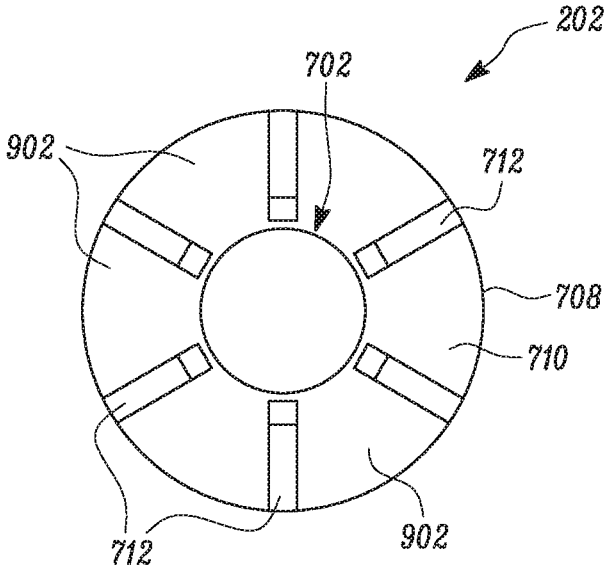
FIG. 9 is a bottom view of the push rod assembly of FIG. 7, according to one embodiment of the present disclosure.

In one embodiment, instead of the stopping assembly 204 having the plurality of protruded structures 302, the push rod assembly 202 may include a plurality of protruded structures (shown in FIG. 9). FIG. 7 illustrates a perspective view of the push rod assembly 202 having the plurality of protruded structures, according to one embodiment of the present disclosure.

The push rod assembly 202 may include a rod portion 702 which may be coupled to the piston 208. The rod portion 702 may be adapted to perform the reciprocating movement within the housing 206. The push rod assembly 202 may include a stopper portion 704 having an inner surface 706 and an outer surface 708 opposite to the inner surface 706. The inner surface 706 of the stopper portion 704 may be fixedly engaged with the rod portion 702. The plurality of protruded structures may be adjacently disposed on a first surface 710 of the stopper portion 704. The plurality of protruded structures may form a plurality of grooves 712 by being adjacently disposed. The plurality of grooves 712 may extend from the inner surface 706 of the stopper portion 704 towards the outer surface 708 of the stopper portion 704. The plurality of grooves 712 may allow the fluid to flow towards the outer surface 708. In one embodiment, the plurality of grooves 712 may allow the fluid to flow towards the outer surface 708, when the fluid is accumulated between the stopper portion 704 and the stopping assembly 204.

In one embodiment, the constructional and operational features of the plurality of protruded structures and the plurality of grooves 712 may be similar to the constructional and operational features of the plurality of protruded structures 302 and the plurality of grooves 508, respectively. The plurality of grooves 712 may extend radially from the inner surface 706 of the stopper portion 704 towards the outer surface 708 of the stopper portion 704. In one embodiment, the push rod assembly 202 may include six protruded structures adjacently disposed on the first surface 710 of the stopper portion 704 forming six grooves 712 extending from the inner surface 706 towards the outer surface 708. In one embodiment, at least one groove 712, from the plurality of grooves 712, may have a varying cross-section. In one embodiment, the varying cross-section of the at least one groove 712 may increase from the inner surface 706 towards the outer surface 708.

Figure 8:
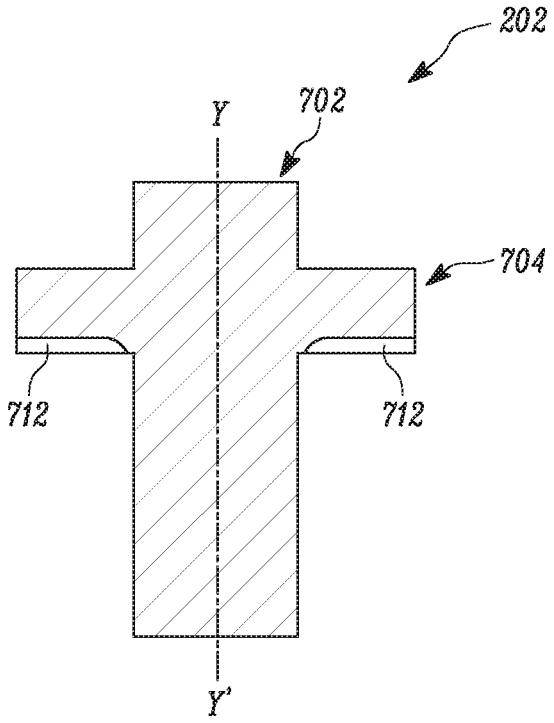
FIG. 8 is a cross-sectional view of the push rod assembly of FIG. 7, according to one embodiment of the present disclosure.

FIG. 8 illustrates a cross-sectional view of the push rod assembly 202 of FIG. 7, according to one embodiment of the present disclosure. Further, FIG. 9 illustrates a bottom view of the push rod assembly 202 of FIG. 7, according to one embodiment of the present disclosure. In the present embodiment, the push rod assembly 202 may include a plurality of protruded structures 902. The plurality of protruded structures 902 and the plurality of grooves 712 may be formed on the first surface 710 of the stopper portion 704.

As would be gathered, in one embodiment, the piston pump 102 may include the plurality of protruded structures 302 formed on the first surface 512 of the base portion 502. In an alternative embodiment, the piston pump 102 may include the plurality of protruded structures 902 on the first surface 710 of the stopper portion 704. In another embodiment, the piston pump 102 may include the plurality of protruded structures 302 and the plurality of protruded structures 902 on the first surface 710 of the base portion 502 and on the first surface 710 of the stopper portion 704, respectively.

INDUSTRIAL APPLICABILITY

The present disclosure relates to the piston pump 102 having the push rod assembly 202 and the stopping assembly 204, according to one embodiment of the present disclosure. The piston pump 102 further includes at least one of the plurality of protruded structures 302 and the plurality of protruded structures 902 adjacently disposed on the first surface 512 of the base portion 502 and the first surface 710 of the stopper portion 704, respectively. The plurality of protruded structures 302, 902 form the plurality of grooves 508, 712 extending outwardly from the inner surface 504, 706 of one of the base portion 502 and the stopper portion 704.

In the present disclosure, the plurality of protruded structures 302, 902 are formed on the push rod assembly 202 and the stopping assembly 204 for allowing the fluid to flow towards the outer surface 506, 708 such that the fluid does not accumulate on the stopping assembly 204 or between the push rod assembly 202 and the stopping assembly 204. However, the scope of the present disclosure is not limited to the push rod assembly 202 and the stopping assembly 204 of the piston pump 102. In other embodiments, the plurality of protruded structures 302, 902 may be formed on any surface of any component to avoid accumulation of fluid, without departing from the scope of the present disclosure.

The piston pump 102 having the push rod assembly 202 and the stopping assembly 204 of the present disclosure offers a comprehensive approach for avoiding accumulation of the fluid on a surface. The plurality of protruded structures 302, 902 can be formed on any surface, for example, on the first surface 512 of the base portion 502 of the stopping assembly 204 and the first surface 710 of the stopper portion 704 of the push rod assembly 202. The plurality of protruded structures 302, 902 forms the plurality of grooves 508, 712 which allows the fluid to flow towards the outer surface 506, 708 and not towards the sealing ring 216. Therefore, the fluid is not accumulated on the stopping assembly 204 or between the stopping assembly 204 and the push rod assembly 202. Further, as the fluid flows towards the outer surface 506, 708, a possibility of development of pressure surges in the fluid is eliminated.

Also, the varying cross-section of the plurality of grooves 508, 712 ensures that the fluid flows in an outward direction. Consequently, the volume of the fluid per work cycle of the piston pump 102 passing through the sealing ring 216 is significantly reduced. Owing to the elimination of the pressure surges and lesser volume of the fluid flowing past the sealing ring 216, the service life of the sealing ring 216 is increased. The lesser volume of the fluid flowing towards the sealing ring 216 may also minimize leakage of the fluid into the lubrication oil.

In addition, the plurality of protruded structures 302, 902 can be formed either on the push rod assembly 202 or on the stopping assembly 204, or on both. Therefore, the present disclosure provides flexibility in terms of providing an outward flow to the fluid. Moreover, the construction of the plurality of protruded structures 302, 902 and the plurality of grooves 508, 712 is simple. As a result, the plurality of protruded structures 302, 902 and the plurality of grooves 508, 712 can be easily manufactured and accommodated on the push rod assembly 202 and the stopping assembly 204. Further, the plurality of protruded structures 302, 902 can be formed on already existing components of the piston pump 102. Therefore, the piston pump 102 of the present disclosure does not include additional components for facilitating an outward flow of the fluid. Therefore, the present disclosure offers the piston pump 102 having the plurality of protruded structures 302, 902 on the push rod assembly 202 and the stopping assembly 204 that is simple, effective, economical, and flexible.

While aspects of the present disclosure have been particularly shown and described with reference to the implementations above, it will be understood by those skilled in the art that various additional implementations may be contemplated by the modification of the disclosed machines, systems and methods without departing from the spirit and scope of what is disclosed. Such implementations should be understood to fall within the scope of the present disclosure as determined based upon the claims and any equivalents thereof.

What is claimed is:

1. A stopping assembly of a piston pump, the stopping assembly comprising:

a base portion having an inner surface for movably receiving a push rod assembly of the piston pump and an outer surface opposite to the inner surface engaged with a housing of the piston pump; and a plurality of protruded structures adjacently disposed on the base portion forming a plurality of grooves extending from the inner surface towards the outer surface to allow fluid to flow towards the outer surface.

2. The stopping assembly of claim 1, wherein the plurality of grooves extends radially from the inner surface towards the outer surface.

3. The stopping assembly of claim 1, wherein the inner surface defines a bore in the base portion for accommodating the push rod assembly.

4. The stopping assembly of claim 1, wherein six protruded structures are adjacently disposed on the base portion forming six grooves extending from the inner surface towards the outer surface.

5. The stopping assembly of claim 1, wherein at least one groove, from the plurality of grooves, has a varying cross-section.

6. The stopping assembly of claim 5, wherein the varying cross-section of the at least one groove increases from the inner surface towards the outer surface.

7. A push rod assembly of a piston pump, the push rod assembly comprising:

a rod portion coupled to a piston of the piston pump, the rod portion adapted to perform a reciprocating movement within a housing of the piston pump;

a stopper portion having an inner surface fixedly engaged with the rod portion and an outer surface opposite to the inner surface; and a plurality of protruded structures adjacently disposed on a first surface of the stopper portion forming a plurality of grooves extending from the inner surface towards the outer surface to allow fluid to flow towards the outer surface.

8. The push rod assembly of claim 7, wherein the plurality of grooves extends radially from the inner surface towards the outer surface.

9. The push rod assembly of claim 7, wherein six protruded structures are adjacently disposed on the first surface of the stopper portion forming six grooves extending from the inner surface towards the outer surface.

10. The push rod assembly of claim 7, wherein at least one groove, from the plurality of grooves, has a varying cross-section.

11. The push rod assembly of claim 10, wherein the varying cross-section of the at least one groove increases from the inner surface towards the outer surface.

12. A piston pump comprising:

a housing;

a piston movably disposed in the housing;

a push rod assembly coupled to the piston to perform a reciprocating movement within the housing along with the piston, the push rod assembly comprising:

a rod portion; and a stopper portion having an inner surface fixedly engaged with the rod portion and an outer surface opposite to the inner surface;

a stopping assembly for limiting a movement of the push rod assembly within the piston pump, the stopping assembly comprising:

a base portion having an inner surface for movably receiving the push rod assembly and an outer surface opposite to the inner surface engaged with the housing; and a plurality of protruded structures adjacently disposed on at least one of a first surface of the stopper portion and a first surface of the base portion, the plurality of protruded structures forming a plurality of grooves extending outwardly from the inner surface of one of the stopper portion and the base portion.

13. The piston pump of claim 12, wherein the plurality of grooves extends radially from the inner surface of one of the stopper portion and the base portion.

14. The piston pump of claim 12, wherein the inner surface of the base portion defines a bore in the base portion for accommodating the push rod assembly.

15. The piston pump of claim 12, wherein six protruded structures are adjacently disposed on at least one of the base portion and the stopper portion forming six grooves extending outwardly from the inner surface of one of the stopper portion and the base portion.

16. The piston pump of claim 12, wherein at least one groove, from the plurality of grooves, has a varying cross-section.

17. The piston pump of claim 16, wherein the varying cross-section of the at least one groove increases from the inner surface of one of the stopper portion and the base portion.

* * * * *